United States Patent [19]

Nichols

[11] 4,409,995

[45] Oct. 18, 1983

[54] METHOD FOR APPLYING PARTICULATE MATTER TO TOBACCO

[75] Inventor: Walter A. Nichols, Richmond, Va.

[73] Assignee: Philip Morris, Inc., New York, N.Y.

[21] Appl. No.: 264,920

[22] Filed: May 18, 1981

Related U.S. Application Data

[63] Continuation-in-part of Ser. No. 162,334, Jun. 23, 1980, abandoned.

[51] Int. Cl.[3] ..... A24B 3/12

[52] U.S. Cl. ..... 131/84 R; 131/288; 131/31; 131/62; 131/79

[58] Field of Search ..... 131/288, 31, 62, 66 A, 131/66, 79, 84 R, 84 A, 287

[56] References Cited

U.S. PATENT DOCUMENTS 2,617,426 11/1952 Patterson ..... 131/287

4,186,754 2/1980 Labbe ..... 131/288

*Primary Examiner*—V. Millin

*Attorney, Agent, or Firm*—Arthur I. Palmer, Jr.; Nelson A. Blish

[57] ABSTRACT

A method and apparatus for applying particulate matter to tobacco during the cigarette making process is disclosed. The amount of particulate matter that is lost during the cigarette making process is minimized by applying the particulate matter to the tobacco as it passes through tongue (30), one of the last steps prior to enclosing the tobacco rod in the cigarette paper at folding unit (42).

9 Claims, 6 Drawing Figures

METHOD FOR APPLYING PARTICULATE MATTER TO TOBACCO

This application is a continuation-in-part of prior copending application U.S. Ser. No. 162,334, filed June 23, 1980 now abandoned.

BACKGROUND OF THE INVENTION

This invention relates to cigarette making machinery and more particularly to method and apparatus for adding particulate matter to tobacco during the cigarette making process.

DESCRIPTION OF THE PRIOR ART

Use of flavorants in tobacco is well known. There are, however, several drawbacks to the methods of applying flavorants to tobacco currently in use. For example, menthol is often applied to tobacco by spraying the tobacco with a dilute menthol solution. This method, however, does not produce a uniform product, since the spray is in the form of discrete droplets which do not contact all of the tobacco. Also, part of the menthol may be lost, using this method, in the course of processing the tobacco.

Another method of applying menthol to tobacco is disclosed by Key, U.S. Pat. No. 3,548,838. This method exposes the tobacco to an alcohol-menthol vapor as the tobacco is blown through a conduit. A defect of this system is that alcohol is an extra expense. Also, there is a danger that the alcohol vapors might reach explosive concentrations.

Davis, U.S. Pat. No. 3,136,321, discloses a method of adding dry, finely divided flavoring material to tobacco. This method involves moistening the tobacco to a water content of about 17 percent to 35 percent. The finely divided material is then blown onto the tobacco and the tobacco is dried to a water content of about 5 percent to 6 percent. This method results in some loss of flavorant as the tobacco is further processed and also leaves some flavor residue in the cigarete making machine. The cigarette making machine must then be cleaned of all residue prior to using the machine to manufacture unflavored cigarettes or cigaretes with a different mixture of flavorants, which is time consuming and expensive.

It is, therefore, an object of the present invention to provide a method and apparatus for adding flavorants to tobacco in such a manner that cleaning is minimized.

A further object of the present invention is to provide a means of adding flavorants to tobacco in such a manner that the loss of flavoring material is minimized.

Another object of the present invention is to provide a method of adding a flavorant to tobacco without exposing personnel to irritating vapors.

An addition object of the present invention is to provide a method of applying flavorants to tobacco with a minimum of expensive, specialized equipment.

SUMMARY OF THE INVENTION

According to the present invention, the foregoing and other objects are attained by providing a conduit opening into the short tongue of a cigarette making machine through which particulate matter is added to the tobacco prior to enclosing the tobacco rod in cigarette paper.

BRIEF DESCRIPTION OF THE DRAWINGS

A more complete appreciation of the invention and many of the attendant advantages thereof will be readily apparent by reference to the following detailed description when considered in connection with the accompanying drawings wherein:

FIG. 2 is a perspective view of the short tongue of the cigarete making machine shown in FIG. 1;

FIG. 3 is a sectional view along the line A—A of the short tongue shown in FIG. 2;

DESCRIPTION OF THE PREFERRED EMBODIMENTS

Figure 1:
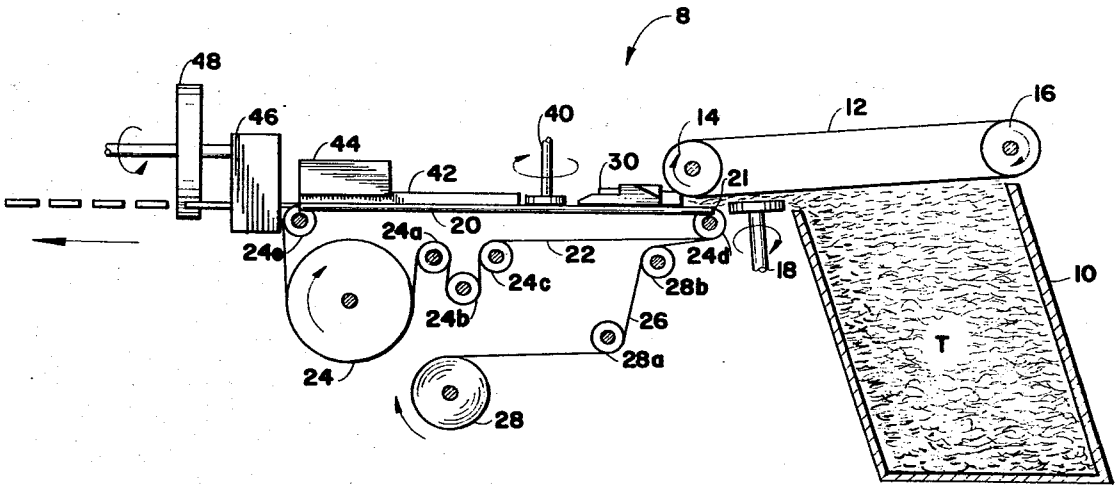
FIG. 1 is a schematic illustration of a cigarette making machine according to the present invention.
Figure 4:
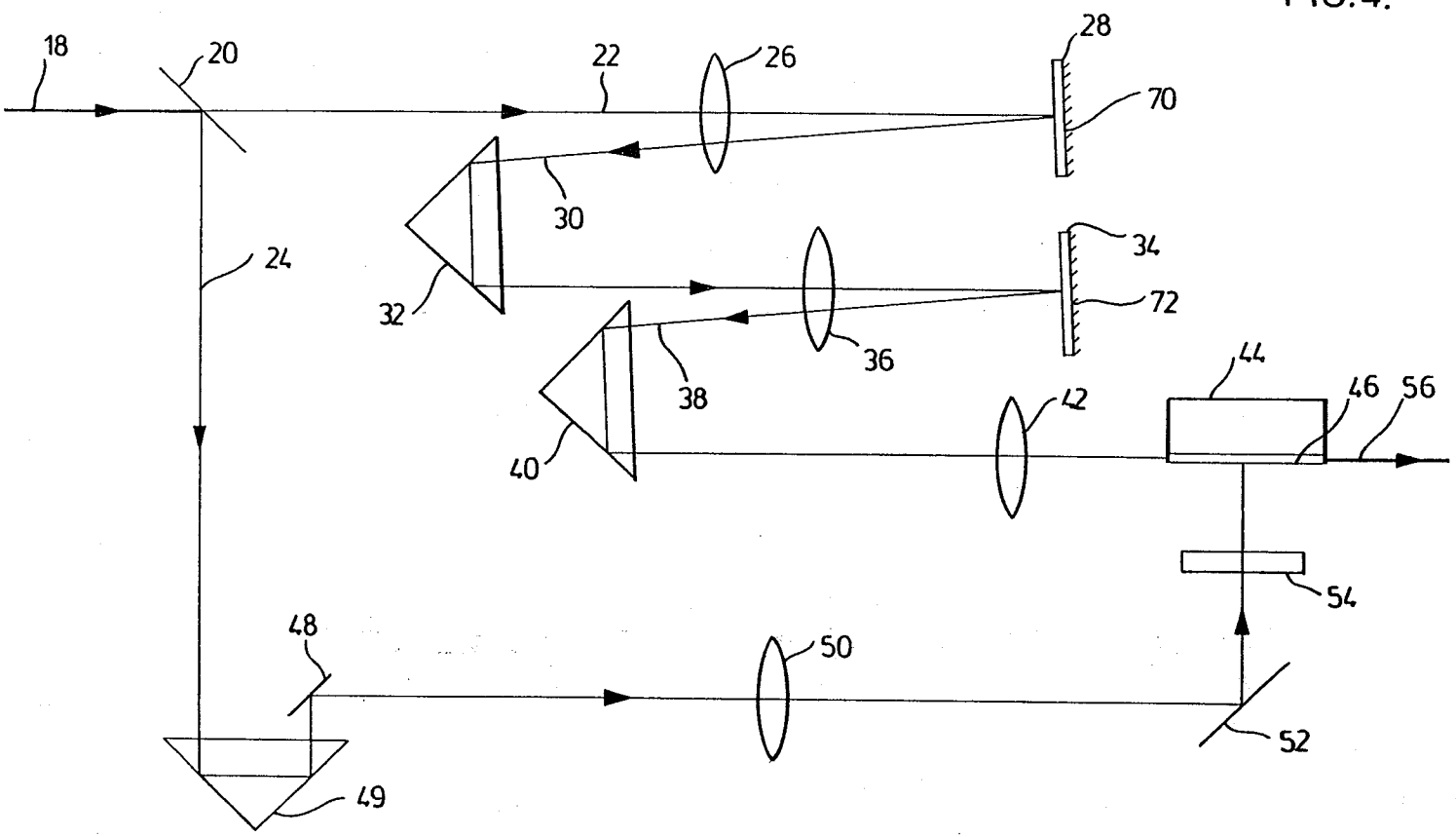
FIG. 4 is a schematic illustration of a cigarette making machine according to another embodiment of the present invention.
Figure 4:
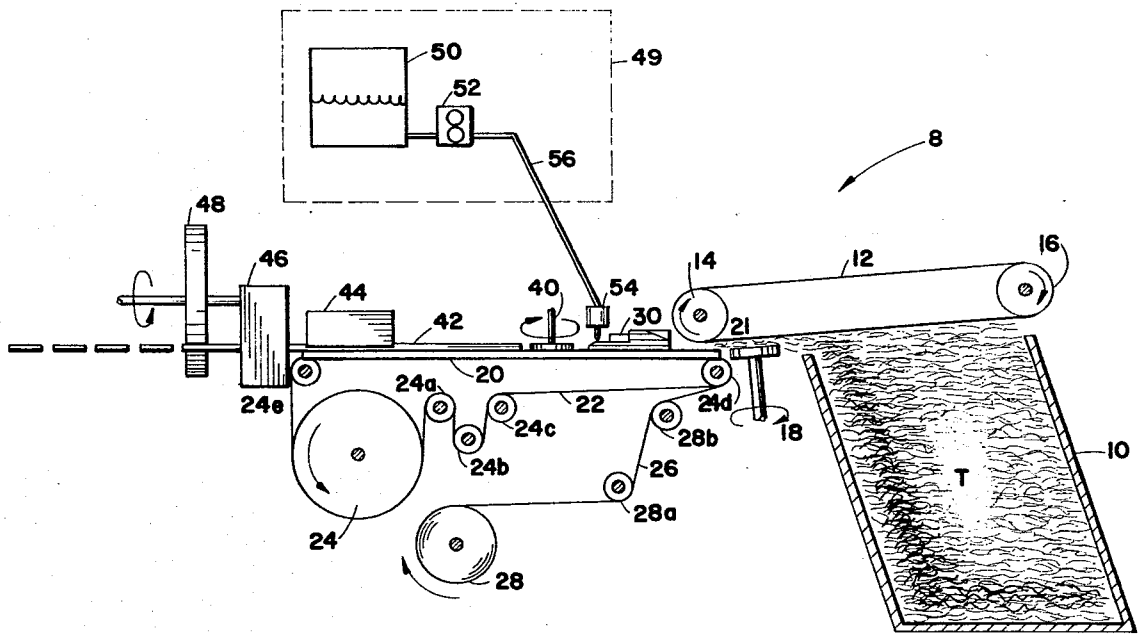

Referring now to the drawings and more particularly to FIG. 1, there is illustrated a cigarette making apparatus, known as the MK8 Cigarette Maker and commercially available from the Molins Company, designated generally by reference numeral 8. Cigarette maker 8 is shown schematically to include tobacco chimney 10 from which tobacco T is blown onto perforated vacuum belt 12, driven by rollers 14 and 16, to convey tobacco T, supported by belt 12, to trimmer knife assembly 18 supported for movement toward or away from the conveyed tobacco to vary the amount of tobacco on belt 12 in accordance with a cigarette weight or density based control signal.

Leftwardly of roller 14, such Molins apparatus includes elongated garniture 20 defining an open channel 19, shown in FIG. 3, extending longitudinally and of generally semi-cylindrical configuration. Endless garniture tape or belt 22 is fed to upstream tobacco input mouth 21 of the garniture and transported through the garniture 20 by drive wheel 24 over idler rollers **24*a*–24*e*. Cigarette paper 26 is fed to mouth 21 atop garniture tape 22 from supply roll or bobbin 28 over idler rollers 28*a*, 28*b*, and 24*d*. Tobacco falls from belt 12 onto paper 26 as vacuum is removed from the belt. On entry of garniture tape 22 in the garniture channel 18, the garniture imparts generally semi-cylindrical shape thereto, like shape being thereby imparted to paper 26 and the tobacco T deposited thereon from belt 12, the open semi-circular cross-section of the tape, paper and tobacco being shown in FIG. 3**.

Short tongue 30 of such Molins apparatus shown in FIGS. 1 and 2, comprising compression foot 32 and cantilever beam member or arm 34, is located downstream of garniture mouth 21. Compression foot 32 is cooperative with garniture 20 to impart generally cylindrical form to the tobacco to form a tobacco rod 27, shown in FIG. 3. To this end, compression foot 32 defines an open channel extending longitudinally therein and also of generally semi-cylindridal configuration, the open semi-cylindrical configuration cross-section of such channel being shown in FIG. 3. One end of beam 34 is fixedly secured, as by bolt 36 to base 38, FIG. 2, and, the opposite end of beam 34 is integral, or otherwise in supporting relation, with stem **32*a* of compression foot 32. Particulate matter is added to the tobacco rod via conduit 33 as tobacco T is formed into a rod by garniture 20 and compression foot 32**.

As the formed tobacco rod 27 leaves short tongue 30, a length of cigarette paper 26 extends tangentially from the paper-wrapped rod. Paster wheel 40, shown in FIG. 1, applies an adhesive to such extending length of paper whereupon unit 42 folds such pasted length over and unit 44 heat seals the rod. The sealed continuous rod now passes through nuclear density gage 46 and is then cut by rod cutoff mechanism 48.

Referring now to FIG. 3, there is shown a schematic, sectional view of the interaction of compression foot 32 and garniture 20 in forming tobacco rod 27. As tobacco rod 27 passes under compression foot 32, particulate matter, such as flavoring, is deposited on tobacco rod 27. The particulate matter is conveyed to tobacco rod 27 by means of a pneumatic stream through conduit 33. The amount of flavoring that is lost is minimized because tobacco rod 27 is closely confined at this point in the manufacturing process.

This method of adding flavoring material to tobacco may be used whether the flavoring material is a particulate material, in the form of a solid, or a liquid. In the case of liquid flavorant, the liquids may be encapsulated. Such encapsulating means are well known. One such method is described by McGlumphy in the U.S. Pat. No. 3,550,598. Encapsulating liquid flavorants, especially highly volatile ones, reduce the amount of flavorant lost due to vaporization.

Figure 5:
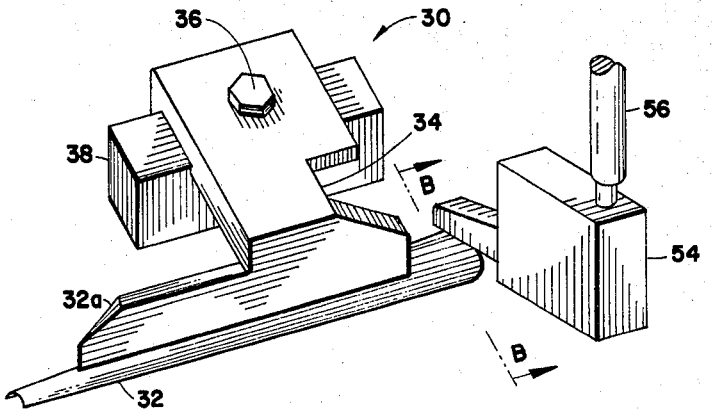
FIG. 5 is perspective view of the short tongue of the cigarette making machine shown in FIG. 4.

For some compounds which are solid at ambient temperatures it may be desirable to heat the compound and apply it as a liquid. For example, it may be desirable to heat menthol above its melting point 41°–43° C. and apply the compound as a hot melt. FIG. 5 shows a cigarette making machine 8 adapted to apply a hot melt compound to tobacco. A hot melt adhesive applicator 49 such as is available commercially from Mercer Corporation, 110 Taylor Industrial Blvd. Hendersonville, Tenn., Model 200, is used to apply the hot melt compound. Hot melt adhesive applicator 49 consists of a heated reservoir 50, for raising the compound to the proper temperature, a pump 52, and a heated pipe 56. Heated pipe 56 maintains the hot melt compound at the proper temperature while being pumped from reservoir 50 to nozzle assembly 54. This apparatus may also be used to a vaporized material to the tobacco.

Figure 6:
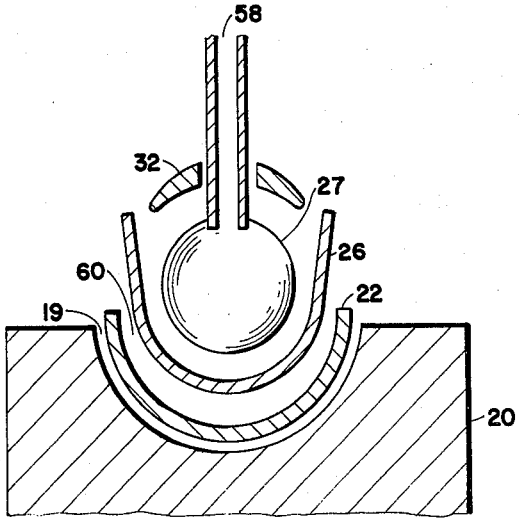
FIG. 6 is sectional view along the lines B—B of the short tongue shown in FIG. 5.

Nozzle 58, shown in FIG. 6, carries the hot melt compound from nozzle assembly 54 through compression foot 32 to tobacco rod 27. Because the short tongue 30 may act as a heat sink and cause the hot melt compound to crystallize in nozzle 58, an air gap is maintained between nozzle 58 and compression foot 32. Alternatively, insulating material could be used between compression foot 32 and nozzle 58. FIG. 6 shows nozzle 58 penetrating tobacco rod 27. However, the tip of nozzle 58 may be flush with the lower surface of compression foot 32 so as to apply the hot melt compound to the surface area of tobacco rod 27.

Adding flavoring to tobacco by the above method is thus seen to be more economical than methods currently in use since less of the material is lost during the cigarette making process. Also, production workers are not exposed to potentially irritating vapors. Also, less production time is lost when changing to a different flavoring additive since only the short tongue must be cleaned rather than the entire machine. Thus, by a relatively minor modification to an existing cigarette making machine, the cigarette making process is made more efficient and less expensive.

I claim:

1. A method of adding matter to cigarettes comprising the steps of:

a. depositing cigarette paper and tobacco on a garniture tape;

b. imparting curvature to said garniture tape, cigarette paper, and tobacco by passing said garniture tape over a garniture;

c. compressing and forming said tobacco into a rod by means of a short tongue;

d. adding flavoring matter to said tobacco by means of a conduit passing through a compression foot of said short tongue.

2. A cigarette making method as in claim 1 wherein said matter is particulate matter in the form of a finely divided solid.

3. A cigarette making method as in claim 1 wherein said matter is a liquid.

4. A cigarette making method as in claim 1 wherein said matter is an encapsulated liquid flavorant.

5. A cigarette making method as in claim 1 wherein said matter is encapsulated menthol.

6. A cigarette making method as in claim 1 wherein said conduit means is separated from said compression foot by an air gap.

7. A cigarette making method as in claim 1 wherein an insulating material is inserted between said conduit means and said compression foot.

8. A cigarette making method as in claim 6 wherein said matter is a compound which has been raised above its melting point.

9. A cigarette making method as in claim 7 wherein said matter is a compound which has been raised above its melting point.

* * * * *